US005353702A

United States Patent [19]

Dengel et al.

[11] Patent Number: 5,353,702

[45] Date of Patent: Oct. 11, 1994

[54] DEVICE FOR ENGAGING AND DISENGAGING AN INKING UNIT AND DAMPENING UNIT DRIVE

[75] Inventors: Uwe Dengel, Dielheim; Rudi Junghans, Wilhelmsfeld, both of Fed. Rep. of Germany

[73] Assignee: Heidelberger Druckmaschinen AG, Heidelberg, Fed. Rep. of Germany

[21] Appl. No.: 122,763

[22] Filed: Sep. 16, 1993

[30] Foreign Application Priority Data

Sep. 16, 1992 [DE] Fed. Rep. of Germany ..... 4230937

[51] Int. Cl.[5] ..... B41F 7/40; B41F 31/32; B41L 27/32

[52] U.S. Cl. ..... 101/148; 101/352

[58] Field of Search ..... 101/147, 148, 350, 351, 101/352, 349, 247, 137, 139, 140, 143, 144, 182, 184, 185, 192

[56] References Cited

U.S. PATENT DOCUMENTS 4,590,858 5/1986 Sedlak et al. .
4,699,053 10/1987 Wenzel ..... 101/352
4,872,406 10/1989 Kusch ..... 101/352

FOREIGN PATENT DOCUMENTS 0380031 1/1990 European Pat. Off. .
0444225 9/1991 European Pat. Off. .
1213428 3/1966 Fed. Rep. of Germany .
103669 3/1924 Switzerland .
640660 7/1950 United Kingdom .

*Primary Examiner*—J. Reed Fisher
*Attorney, Agent, or Firm*—Herbert L. Lerner; Laurence A. Greenberg

[57] ABSTRACT

A device for coupling and uncoupling inking unit and dampening unit drives in rotary printing machines is actuated with an operator-accessible control knob mounted at a printing unit. A sensor assembly detects a safety rest or safety release movement of the control knob preceeding a switching movement of the control knob. A control shaft is connected to and rotatable by the control knob. A cam member with a cam surface is mounted on the control shaft. The cam surface is followed by sensing devices which continuously sense the cam surface. A traverser bushing is axially movably mounted in the printing unit. Transmission members are connected between the control knob and the traverser bushing for converting a switching movement of the control knob to an axial movement of the traverser bushing. The axial movement of the traverser bushing is between defined positions which cause the inking and/or dampening unit drives to be engaged and disengaged.

9 Claims, 4 Drawing Sheets

DEVICE FOR ENGAGING AND DISENGAGING AN INKING UNIT AND DAMPENING UNIT DRIVE

BACKGROUND OF THE INVENTION

1. Field of the Invention

The invention relates to a device for engaging and disengaging an inking unit drive and a dampening unit drive at a rotary printing machine.

Engaging and disengaging, i.e. coupling and uncoupling, of inking unit or dampening unit drives—for example in one-sided printing of a material web—has been practiced before. But such coupling is effected place directly at the coupling gear, after a side wall of the corresponding printing unit has been exposed. No electrically defined monitoring of the individual coupling modes has heretofore been attempted in the art.

2. Description of the Related Art

German patent DE 28 19 257 C3 shows a device for releasing or locking the pivot motion of a lifter roller actuated by a control cam. In that device, two rigidly connected eccentric cams are mounted on a control shaft and one catch each is mounted on the eccentrics which can be brought to a lifter shut-off lever in an operating position. That device is not secured, both in terms of the individual switching positions of the control shaft and in terms of actuating the device immediately prior to the switching operation. As described, the control shaft is secured against being pulled out merely with a safety retaining ring.

SUMMARY OF THE INVENTION

It is accordingly an object of the invention to provide a device for engaging and disengaging an inking unit and dampening unit drive, which overcomes the hereinafore-mentioned disadvantages of the heretofore-known devices of this general type and which, among other advantages, allows freely accessible actuation of the drive couplings with a number of safety features which prevent damaging operator errors.

In general, the object is to further develop a device for disengaging and engaging an inking unit and dampening unit drive, such that the respective switching positions of the device for disengaging and engaging are electrically monitorable and operator errors do not cause consequential damage.

With the foregoing and other objects in view, there is provided, in accordance with the invention, a device for engaging and disengaging an inking unit and dampening unit drive in a rotary printing machine, comprising:

- an operator-accessible control knob mounted at a printing unit and defining switching positions;
- a sensor assembly mounted at the printing unit for detecting a safety rest or safety release movement of the control knob preceeding a switching movement of the control knob;
- a control shaft connected to and being rotatable by the control knob, a cam member with a cam surface disposed on the control shaft, cam follower means in the form of sensing devices for continuously sensing the cam surface;
- a traverser bushing axially movably mounted in the printing unit; and
- transmission means, such as a pivot member and a lever connected between the control knob and the traverser bushing, for converting a switching movement of the control knob to an axial movement of the traverser bushing.

In again other words:

- a control knob provided at at least one printing unit in a freely accessible manner can be switched into several rest positions (switching positions);
- a safety rest or safety release movement of the control knob which preceeds a switching movement of the control knob is detectable by a sensor assembly;
- a control shaft is provided with a cam member, the profiling of which is continuously sensed with sensing devices; and
- the switching movement of the control knob is converted to an axial movement of a traverser bushing by means of transmission elements.

The advantages of the solution according to the invention, among others, are found in the fact that no component disassembly is necessary for operating the coupling. The device can be operated—due to the free accessibility—in a simple manner from outside the printing unit. A safety release movement of the control knob which preceeds the rotation thereof is sensorically monitored, so that the machine is automatically stopped when such a movement is detected. Thereafter, the device for uncoupling and coupling may be freely operated. Due to the fact that a cam element provided on the control shaft allows continuous monitoring of the position of the control shaft and thus of the operating mode of the inking and dampening units, i.e. also between the rest positions, and is also sensed by means of sensing devices, redundancy is given. Both from the position of the control knob and from an electrical pulse which corresponds to the angular position of the control shaft, the operating mode of the device according to the invention may be determined. Furthermore, the conversion of the rotational movement of the control knob into a translational movement of the traverser bushing allows the device to be operated under only small control forces.

In accordance with an added feature of the invention, the device includes sliding bushings disposed on the control shaft and the control knob is mounted on the sliding bushings. Means are also provided for non-rotatably locking the control knob to the control shaft while the sliding bushings allow the control knob to axially slide on the control shaft. In other words, it is provided that the control knob is received on sliding bushings of the control shaft. The sliding bushings make a safety rest or safety release movement of the control knob in an axial direction possible while a form lock makes the transmission of a rotational movement possible.

In accordance with an additional feature of the invention, the device includes biasing elements for providing a biasing force against a safety release movement of the control knob. This assures that the machine control does not attempt to start the machine while the device for engaging and disengaging is in an undefined switching position. When the lock (arresting) bolt is not received in a corresponding lock bore or notch at the periphery of the control knob, then the sensor assembly detects the same, because the distance between the control knob and the sensor assembly is greater than in the engaged condition. The biasing elements force the machine control to a fully executed control operation; otherwise, the machine is not allowed to start after a switching operation.

In accordance with again another feature of the invention, the control knob has locking bores formed therein, and the device includes arresting bolts mounted at the printing unit at locations corresponding to the switching positions and engaging in the locking bores formed in the control knob. The engaging motion is preferably supported by spring action.

In accordance with a concomitant feature of the invention, the device includes a toothed rim rotatably supported on the traverser bushing. Furthermore, first, second and third axial positions of the traverser bushing are defined. The first axial position being defined when the toothed rim meshes with a drive connector for an inking unit and a drive connector for a dampening unit, the second position being defined when the toothed rim meshes with the drive connector for the dampening unit but the meshing connection with the drive connector for the inking unit is interrupted, and the third position being defined when the traverser bushing is further axially shifted so that the meshing connection between the toothed rim and the drive connectors for the inking unit and for the dampening unit are interrupted.

It is provided that lock bolts corresponding to lock positions at the printing unit lock into lock bores of the control knob in a spring-supported fashion. This causes a defined switching position. Furthermore, a toothed rim is rotatably mounted on the traverser bushing. The control forces necessary to operate the device for engaging and disengaging can be kept small. In the case of an axial shift of the traverser bushing, the tooth-engagement between the toothed rim and a drive connector for an inking unit is first disconnected, and in a further axial shift of the traverser bushing, the tooth-engagement between the toothed rim and a drive connector for a dampening unit is disconnected.

Other features which are considered as characteristic for the invention are set forth in the appended claims.

Although the invention is illustrated and described herein as embodied in a device for engaging and disengaging an inking unit and dampening unit drive, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
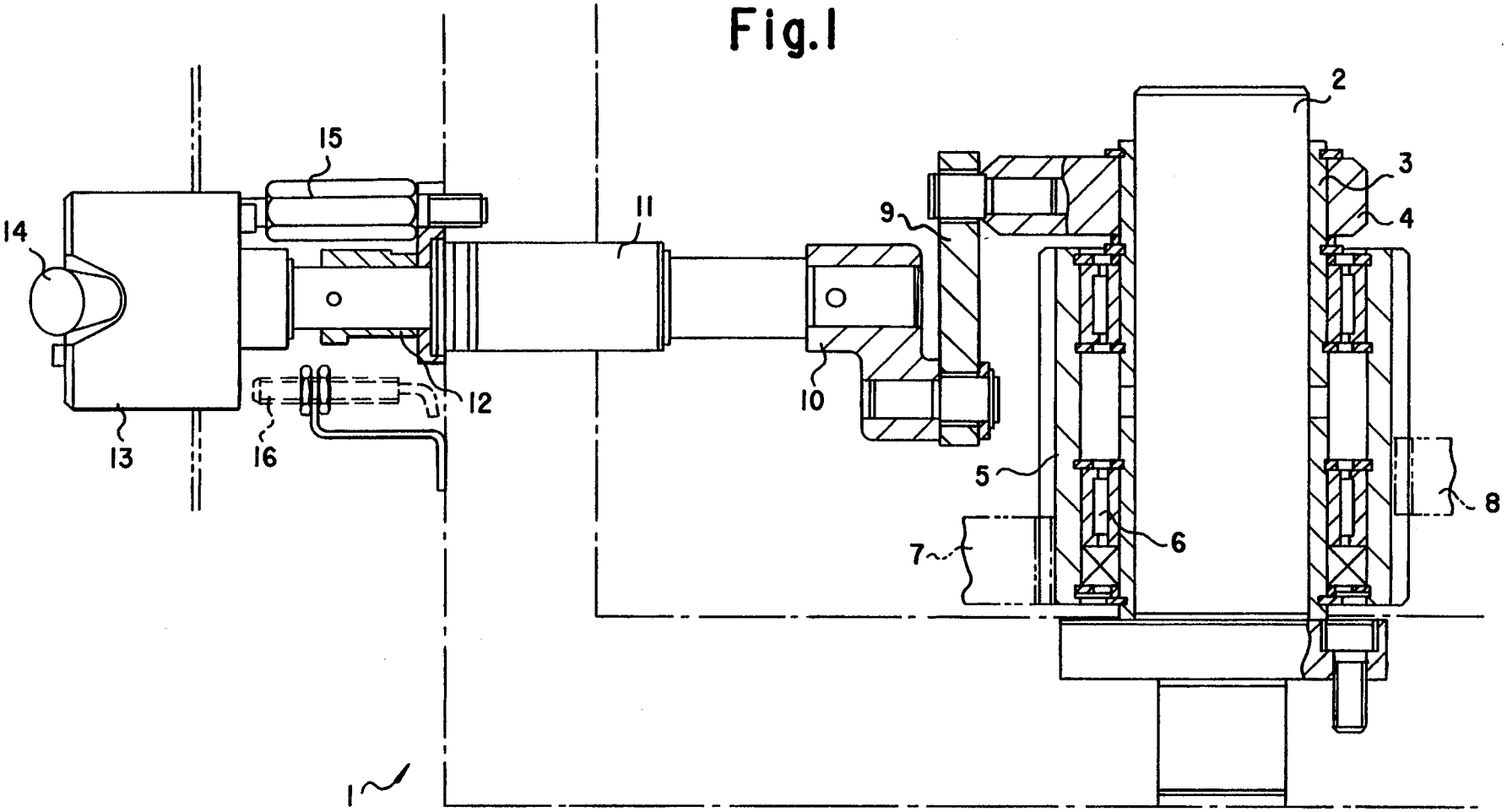
FIG. 1 is a top-plan view of the device according to the invention with schematically indicated printing unit walls.

Referring now to the figures of the drawing in detail and first, particularly, to FIG. 1 thereof, there is seen a top-plan view of the device according to the invention with schematically indicated printing unit walls 1.

A trunnion 2 is received in the side wall 1 of the printing unit. An axially shiftable traverser bushing 3 is mounted on the trunnion 2. A lever 4 is disposed at the traverser bushing 3. A gear or toothed rim 5 is rotatably supported on the traverser bushing 3. The toothed rim 5 is mounted in pin bearings or needle bearings 6. Depending on its axial position on the trunnion 2, the toothed rim 5 meshes with a drive connector 7 for an inking unit and/or with a drive connector 8 for a dampening unit. As shown in FIG. 1, the two drive connectors 7 and 8 mesh with the teeth of the rim 5 simultaneously. The toothed rim 5, therefore, allows the interruption of a drive train to the inking and dampening unit of the printing unit 1.

The distal end of the lever 4 which is mounted on the periphery of the traverser bushing 3 is connected with a lever 9 which, in turn, is articulatingly connected with a pivot member 10. The pivot member 10 is provided with an eccentric ear or adapter and it is connected with a control shaft 11, secured with a cylinder pin connector. The control shaft 11, which extends through the side wall 1 of the printing unit, is provided with a torsionally rigid cam member 12 having a given cam profiling. Further, the side wall of the printing unit 1 carries a sensor assembly 16 and several locking bolts or arresting bolts 15, which cooperate with a control knob 13. A hand lever 14 is provided for operating the control knob 13.

When the control knob 13 is in an arrested position at one of the arresting bolts 15, then the distance between the sensor assembly 16 and the control knob 13 is as shown in FIG. 1. The supply current loop of the machine is closed and the machine operates. When a press operator grabs the hand lever 14 while the machine is in operation, then the control knob 13 must be pulled in an axial direction, i.e. the safety catch (the locking bolt 15) must be released, so that subsequently the control knob 13 can be rotated. The sensor assembly 16 registers the distance change during the releasing axial movement and causes the machine to stop.

Figure 2:
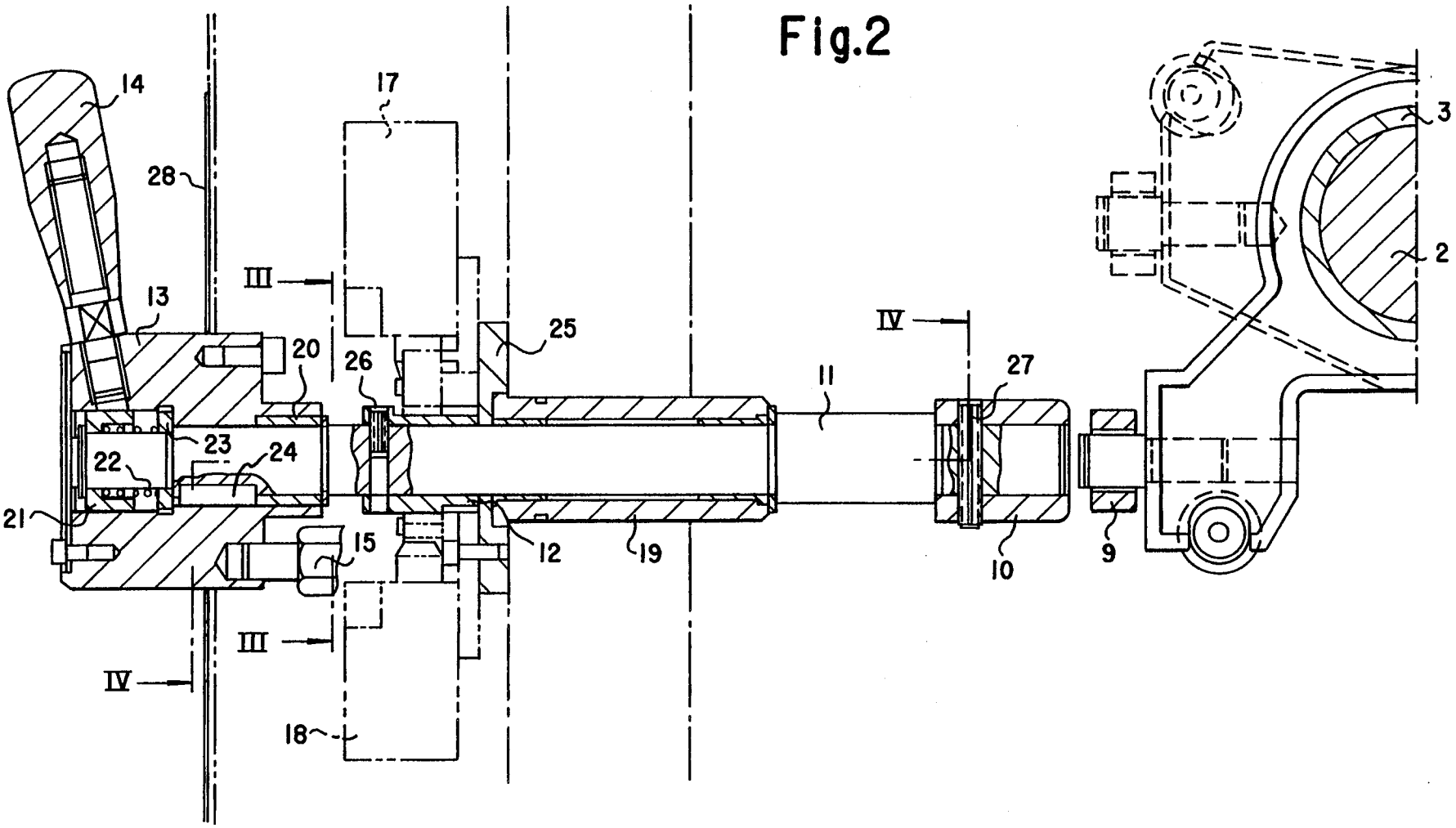
FIG. 2 is a longitudinal section through the device according to FIG. 1.

Referring now to the longitudinal section of FIG. 2, a sleeve bushing 19 is mounted in the schematically illustrated side wall 1 of the printing unit. The control shaft 11 is guided in the bushing 19. The pivot member 10 is received at one end of the control shaft 11 and secured with a locking pin 27. As already explained, the pivot member 10 is articulatingly connected with the lever 9.

A plate 25 is provided in the region of the bushing 19 at the side wall 1 of the printing unit. Sensing devices 17 and 18 are mounted on the plate 25. In the region of the sensing devices 17 and 18 the control shaft 11 carries a cam member 12 which is non-rotatingly mounted thereon. Furthermore, sliding bushings 20 and 21 are disposed on the control shaft 11 which allow an axial movement of the control knob 13. A spring 22 is provided inside the control knob 13 between the sliding bushing 21 and a stop 23 in the form of a ring. The control knob 13 is further form-lockingly connected with the control shaft 11 by means of an adjusting spring 24. The control knob 13, which is partly disposed inside the side wall cover, is further provided with the hand lever 14.

In order the change the switching position of the control knob 13, the press operator must move the control knob 13 in an axial direction, because the locked arresting bolt 15 would not otherwise allow a rotation. After it has been pulled out, the control knob 13 can then be rotated against the biasing return force of the spring 22 and after the release from the corresponding arresting bore. During the rotation of the control knob 13 the arresting bolt 15 slides on the face of the control knob 13 and thus maintains the same at that distance. The sensor assembly 16 detailed in FIG. 1 causes the machine to remain stopped as long as the control knob is not locked in. During the rotation of the control knob 13, the sensing devices 17 and 18 scan the contour of the profiled cam member 12. This makes it possible to electrically transmit the angular position of the control shaft 11 and thus the coupling position of the traverser bushing 3 to the machine control.

Besides the electrical detection of the switching condition through limit switches provided in the sensing devices 17 and 18, the operating position of the device for engaging and disengaging can also be read from the position of the hand lever 14 in relation to switching symbols provided on an operator panel 28.

Figure 3:
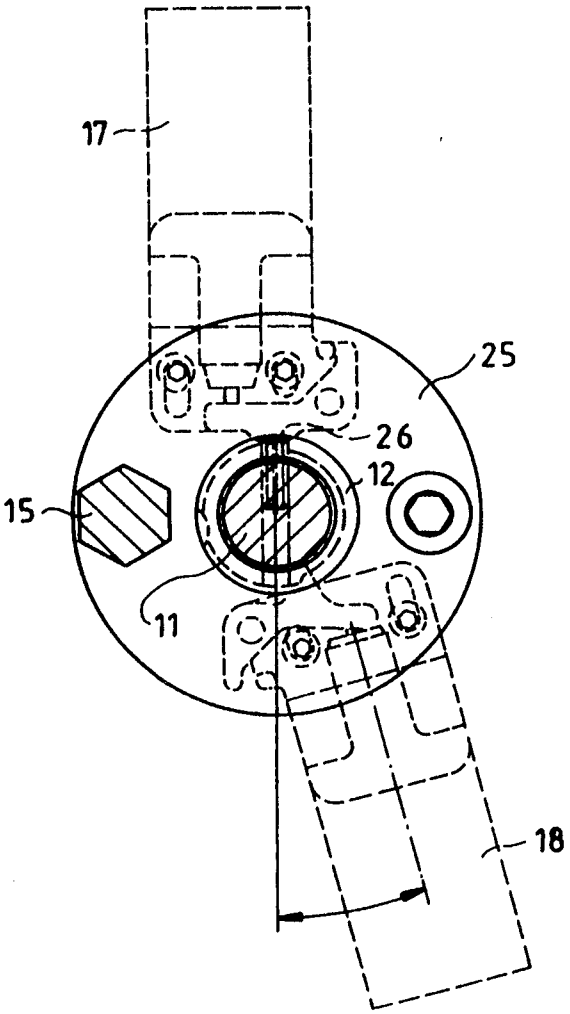
FIG. 3 is a cross-sectional view taken along the line III—III in FIG. 2.

Referring now to the cross-section of FIG. 3, two mutually opposite sensing devices 17 and 18 are mounted on the plate 25. The sensing tips of the sensing devices 17 and 18 are guided on the contour of the cam member 12, i.e. they are cam followers. The contour of the cam member 12 has a lower region or dwell extending about 180° about the periphery of the cam member 12. A rest notch for a sensing tip is provided on the peripheral segment of the cam member 12 opposite the lower region which is relatively higher, i.e. on the 180° lobe segment. An arresting bolt 15 is bolted at the plate 25 and it engages in locking bores at the forward face of the control knob 13. The cam member 12 is non-rotatably mounted on the control shaft 11 by means of the cylinder pin 26.

Figure 4:
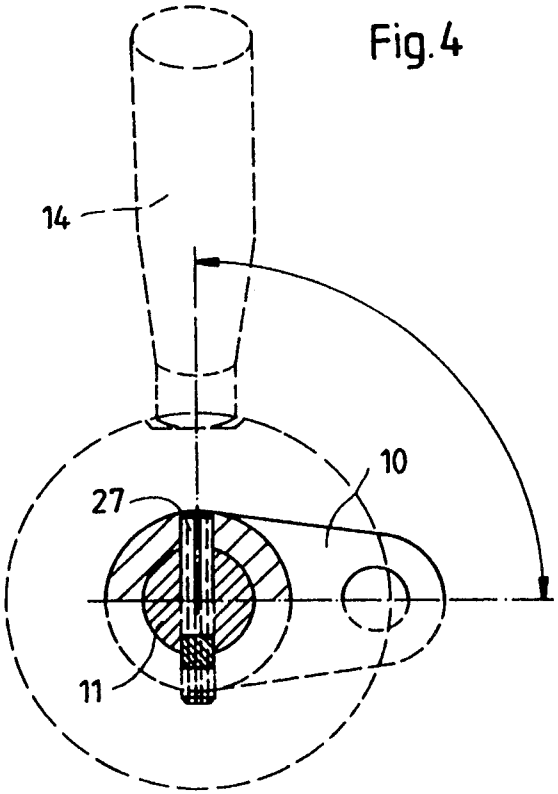
FIG. 4 is a cross-sectional view taken along the line IV—IV in FIG. 2.

Referring now to the cross section of FIG. 4, the hand lever 14 of the control knob 13 is perpendicular relative to the pivot member 10, which is non-rotatably connected with the control shaft 11 by means of the cylinder pin 27. The adjusting spring 24 causes a form-locking connection of the control knob 13 with the control shaft 11 in such a way that the axial movement of the control knob on the sliding bushings 20 and 21 of the control shaft 11 remains possible.

Figure 5:
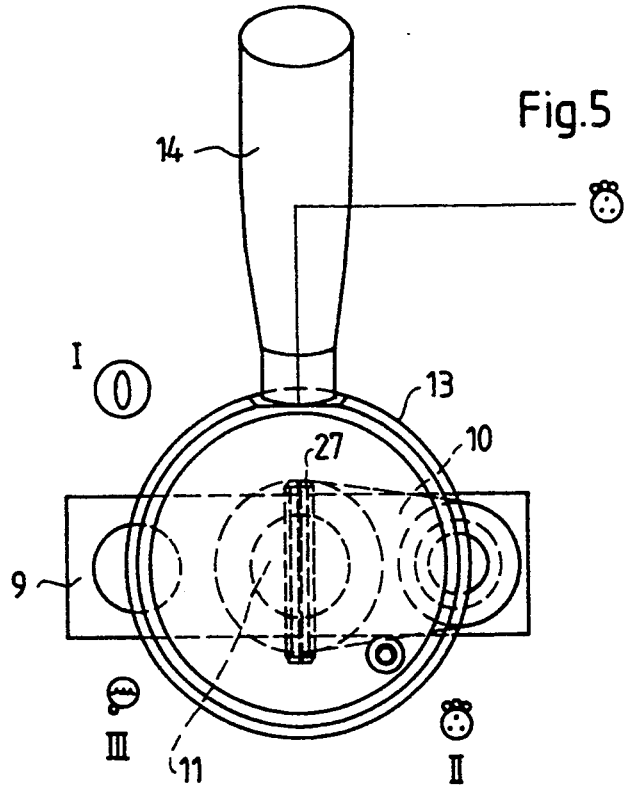
FIGS. 5 and 6 show various switching positions of the device according to the invention.

With reference to FIG. 5, the hand lever 14 of the control knob 13 stands in a position I. The pivot member 10 and the lever 9 are in a position which is also shown in the top-plan view of FIG. 1. The position I thus illustrates the switching position of the device for engaging and disengaging in which both the drive connector 7 for the inking unit as well as the drive connector 8 for the dampening unit are engaged with the toothed rim 5 mounted on the traverser bushing 3, i.e. they are driven.

Figure 6:
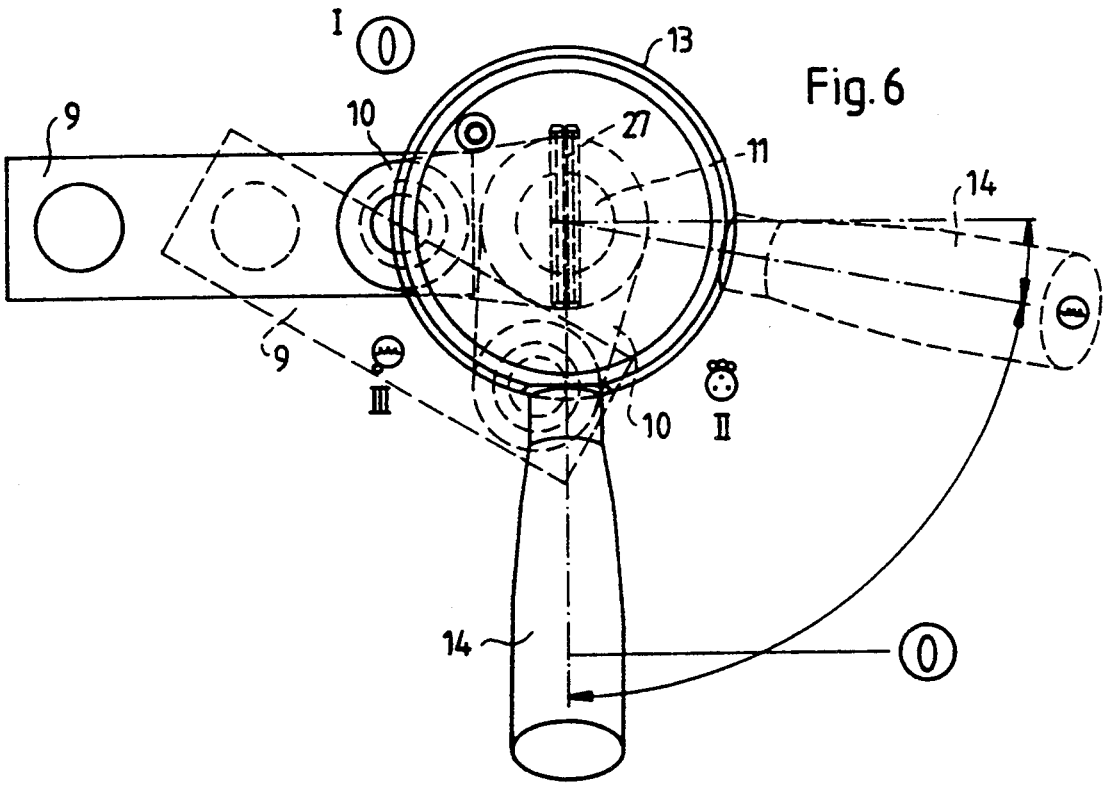

With reference to FIG. 6, on the other hand, two further switching positions of the device according to the invention are referenced as angular positions II and III. The position II is indicated with dashed lines. The hand lever 14 and thus the control knob 13 are rotated by about 90° as compared with the position of FIG. 5. The pivot member 10 and the lever 9 are also in changed positions. In the position II the inking unit is disengaged, the traverser bushing 3 has been pushed to slide on the trunnion 2 away from the printing unit side wall. This causes the engagement between the toothed rim 5 and the drive connector 7 for the inking unit to be disrupted; the inking unit is thus disengaged. With a further rotation of the hand lever 14 and the control knob 13 by 90° , the position III is reached. The pivot member 10 and the lever 9 assume the positions shown in solid lines; this is a stretched position of the lever 9 and the pivot member 10. As compared to the configuration shown in FIG. 1, the traverser bushing 3 is further pushed away from the printing unit side wall 1, so that the drive connector 8 for the dampening unit is also interrupted.

In the position III, therefore, both the inking unit and the dampening unit are separated from the drive. In the position II only the inking unit is disengaged. These switching positions can only be changed when the machine is at a stillstand. If this is not the case, then the machine is automatically stopped when the sensor assembly 16 detects an axial movement which preceeds the actual switching movement, so that the switching position change may be effected.

We claim:

1. A device for engaging and disengaging an inking unit and dampening unit drive in a rotary printing machine, comprising:

an operator-accessible control knob mounted at a printing unit and defining switching positions;

a sensor assembly mounted at the printing unit for detecting a safety rest or safety release movement of said control knob preceeding a switching movement of said control knob;

a control shaft connected to and being rotatable by said control knob, a cam member with a cam surface disposed on said control shaft, cam follower means in the form of sensing devices for continuously sensing said cam surface;

a traverser bushing axially movably mounted in the printing unit; and transmission means connected between said control knob and said traverser bushing for converting a switching movement of said control knob to an axial movement of said traverser bushing.

2. The device according to claim 1, wherein said transmission means include a pivot member connected to said control shaft and a lever connected between said pivot member and said traverser bushing.

3. The device according to claim 1, including sliding bushings disposed on said control shaft, said control knob being mounted on said sliding bushings.

4. The device according to claim 3, including means for non-rotatably locking said control knob to said control shaft while said sliding bushings allow said control knob to axially slide on said control shaft.

5. The device according to claim 1, including biasing elements for providing a biasing force against a safety release movement of said control knob.

6. The device according to claim 1, wherein said control knob has locking bores formed therein, and including arresting bolts mounted at said printing unit at locations corresponding to said switching positions and engaging in said locking bores formed in said control knob.

7. The device according to claim 6, including spring means for forcing said arresting bolts to engage in said locking bores.

8. The device according to claim 1, including a toothed rim rotatably supported on said traverser bushing.

9. The device according to claim 8, including means for defining first, second and third axial positions of said traverser bushing, said first axial position being defined when said toothed rim meshes with a drive connector for an inking unit and a drive connector for a dampening unit, said second position being defined when said toothed rim meshes with the drive connector for the dampening unit but the meshing connection with the drive connector for the inking unit is interrupted, and said third position being defined when said traverser bushing is further axially shifted so that the meshing connection between the toothed rim and the drive connectors for the inking unit and for the dampening unit are interrupted.

* * * * *